United States Patent [19]

Hill

[11] 4,370,658

[45] Jan. 25, 1983

[54] ANTENNA APPARATUS AND METHOD FOR MAKING SAME

[76] Inventor: Fred G. Hill, 8591 Ideal Ave. South, Cottage Grove, Minn. 55016

[21] Appl. No.: 258,688

[22] Filed: Apr. 29, 1981

[51] Int. Cl.[3] ..... H01Q 1/32

[52] U.S. Cl. ..... 343/713; 343/873

[58] Field of Search ..... 343/872, 873, 713, 708, 343/711, 712, 704, 715

[56] References Cited

U.S. PATENT DOCUMENTS

| | | | |
|---|---|---|---|
| 1,884,176 | 10/1932 | Pagel et al. . | |
| 2,123,389 | 7/1938 | Wareing | 250/33 |
| 2,129,766 | 9/1938 | Hoskins | 250/33 |
| 2,130,033 | 9/1938 | Scharlau | 343/873 |
| 2,248,236 | 7/1941 | Hollins et al. | 250/33 |
| 2,334,856 | 11/1943 | Atkinson | 296/95 |
| 2,774,811 | 12/1956 | Shanok et al. | 174/110 |
| 2,964,746 | 12/1960 | Trudnak, Jr. et al. | 343/713 |
| 3,015,517 | 2/1962 | Thornburgh | 296/91 |
| 3,543,272 | 11/1970 | Zawodniak | 343/713 |
| 3,576,576 | 4/1971 | Jensen | 343/712 |
| 3,638,225 | 1/1972 | Zawodniak | 343/713 |
| 3,646,561 | 2/1972 | Clarke | 343/711 |
| 3,673,044 | 6/1972 | Miller et al. | 156/433 |
| 3,680,132 | 7/1972 | Tolliver | 343/713 |
| 3,725,944 | 4/1973 | Valeriote, Jr. | 343/873 |
| 3,779,878 | 12/1973 | Swift et al. | 204/140 |
| 3,793,590 | 2/1974 | Etling et al. | 325/312 |
| 3,810,184 | 5/1974 | Boicey et al. | 343/713 |
| 3,816,836 | 6/1974 | Smith | 343/713 |
| 3,816,837 | 6/1974 | Smith | 343/713 |
| 3,818,489 | 6/1974 | Bobel et al. | 343/713 |
| 3,896,448 | 7/1975 | Killen | 343/713 |
| 3,987,449 | 10/1976 | DeAngelis et al. | 343/713 |
| 4,072,952 | 2/1978 | Demko | 343/708 |
| 4,132,994 | 2/1979 | Caldwell | 343/713 |

*Primary Examiner*—David K. Moore

*Attorney, Agent, or Firm*—Merchant, Gould

[57] ABSTRACT

An antenna structure having a generally planar member (23) in which an antenna conductor member (11) is encapsulated within an electrically insulating material. A first layer (23*a*) is formed from a hard gel coating material. A second layer (23*b*) is formed from successive layers of resin, laminating fabric and resin and is placed in overlying engagement with the first layer (23*a*). A first conductor member (11) is positioned on and is slightly embedded within the second layer (23*b*). A third layer (23*c*), similar to the second layer (23*b*) is placed in overlying engagement upon the first conductor member (11). Additional conductor members may be incorporated by placing successive layers of conductor, resin and laminating fabric in overlying relationship. A coupler (18) provides for electrical connection of the antenna conductor member (11) to a receiver/-transmitter within a motor vehicle. The planar member (23) may either form an integral part of the vehicle structure such as a cab cover, or may form an accessory such as an air current deflector shield for mounting to the outside surface of a motor craft.

12 Claims, 9 Drawing Figures

FIG. 1
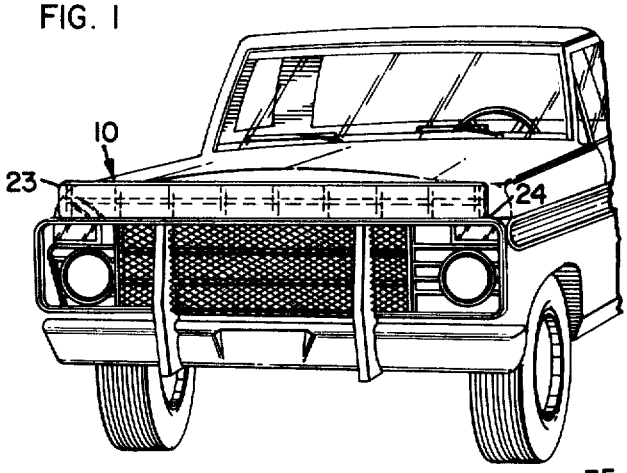
FIG. 3
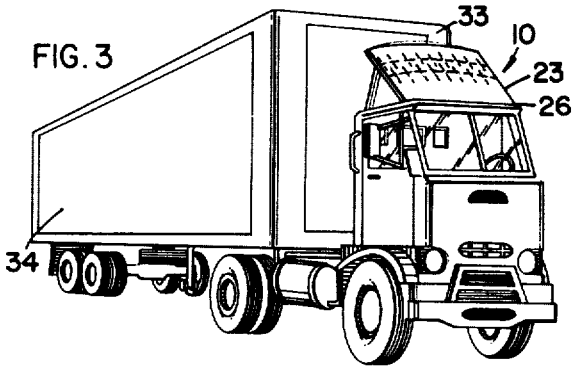
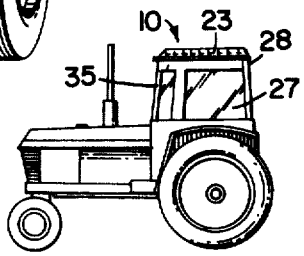
FIG. 4
FIG. 2
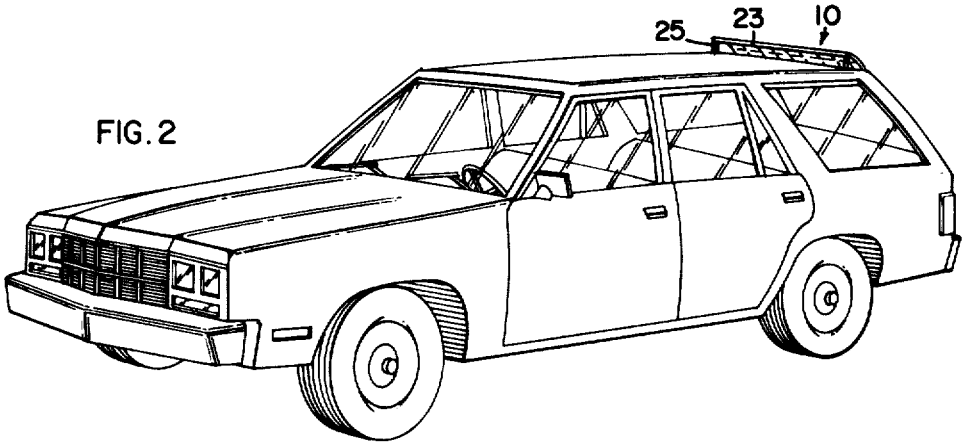

FIG. 7
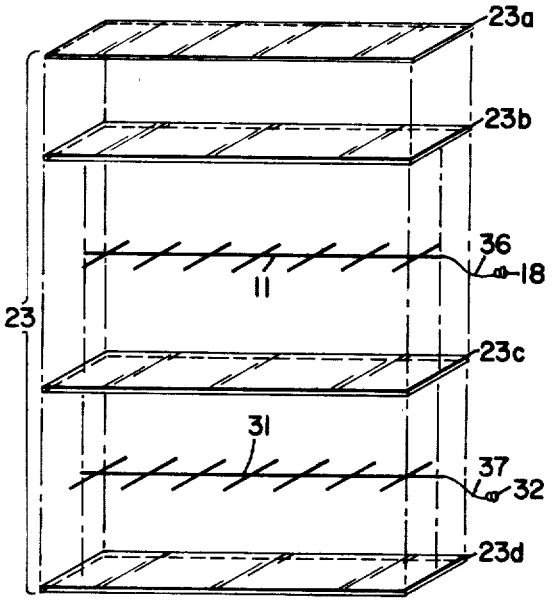
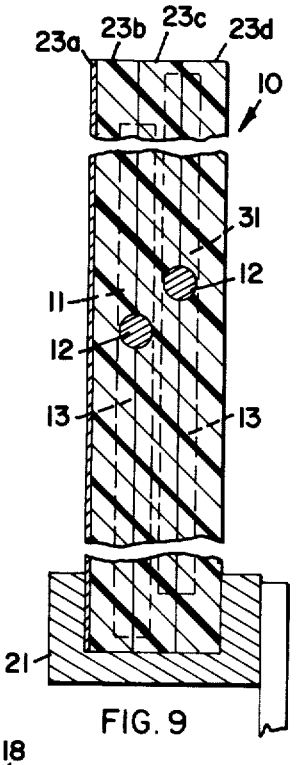
FIG. 9
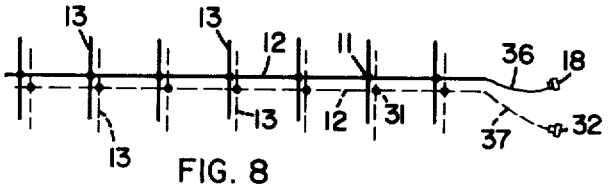
FIG. 8
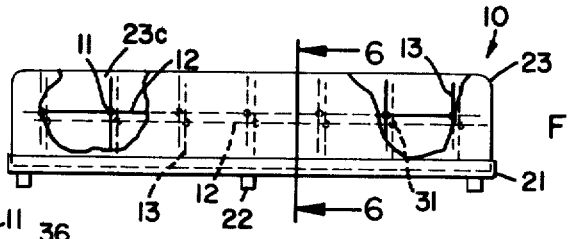
FIG. 5
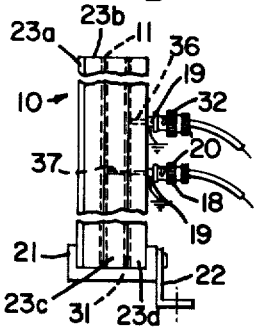
FIG. 6

ANTENNA APPARATUS AND METHOD FOR MAKING SAME

BACKGROUND OF THE INVENTION

1. Field of the Invention

This invention relates generally to an improved antenna for a motor vehicle and to a method of constructing the antenna.

2. Description of the Prior Art

The two forms of motor vehicle antennas that are most commonly used today are the mast antenna and the windshield antenna. The mast antenna comprises a rod conductor projecting outwardly from the motor vehicle body. In such an exposed location, the mast antenna is subject to deterioration by the weather elements, it is prone to damage from striking against external objects, and it is in a location easily accessible to vandals. In addition, the mast antenna is thought by some to detract from the aesthetic appearance of the motor vehicle. Of course, the mast antenna can be made to automatically retract within the motor vehicle body, but such an auxiliary powered arrangement contributes extra cost to the antenna.

In the windshield antenna, one or more very thin conductors are embedded within the windshield of the vehicle. Consequently, the conductors of the windshield antenna are, to a degree, shielded from the weather, damage from striking against external objects, and vandalism. The windshield antenna conducters are thin, typically 30 to 32 gauge. Because the conductors are so thin, they are still susceptible to cracking or breaking, and are not particularly useful as transmission antennas, due to their limited power handling capability. Further, the windshield antenna is somewhat susceptible to various forms of FM distortion, particularly "station swapping", and it is somewhat sensitive to changes in the direction of vehicle travel. Noise may also be generated in the windshield antenna by various accessories of the motor vehicle, such as by windshield wipers. The conductors of the windshield antenna also inevitably add to the cost of replacing a damaged vehicle windshield.

Antennas have also been incorporated into the dashboard of the motor vehicle. Since the dashboard is an integral part of the motor vehicle, to be economically feasible, this type of antenna must be initially ordered with the purchase of the motor vehicle, and is expensive and impractical to replace or repair.

Antennas have also been combined with a variety of motor vehicle accessory parts. These accessory parts include such items as molding, trim, grills, wheel covers, sun visors, side view mirrors, and insect guards for radiators. Such insect guard/deflector for the radiator is of an open mesh structure wherein the mesh itself forms the antenna conductors. In such structure, the conductor members for the antenna are exposed to the elements and, therefore, are susceptible to damage. The prior art insect guard/deflectors protect only the area immediately behind the guard. They do not deflect the air current away from the area, but only act as bug screens.

In general, the prior art antennas that are combined with automobile accessories provide for only one antenna. If two antennas are needed, it is necessary to install two separate units.

The incresed popularity of citizen band radios has created an increased demand for add-on antennas suitable for both reception and transmission. Typically, the standard automobile radio antenna cannot be also used as an antenna for a citizen's band radio unless a switching mechanism is mounted between the antenna and the two radios to enable only one unit at a time to use the antenna. By far, the most popular add-on antenna has been the mast antenna. The mast antenna is often mounted on the roof of the motor vehicle. The mounting base is often magnetic, so that the antenna can easily be removed. It is often necessary or desirable for a roof antenna to be removable because the combined height of the motor vehicle and the antenna may be higher than an overhead obstruction such as a parking ramp ceiling or a garage door. In such cases, the antenna would be damaged if it was not removed before the motor vehicle passed under the obstruction.

It would be advantageous if, when adding an additional antenna to the motor vehicle, the antenna could also provide another function for the motor vehicle, as for example, an air current deflector. An air current deflector shield accessory is normally mounted to the motor vehicle in one of three places. If attached to the front edge of the hood of the motor vehicle, the air current deflector shield deflects the air current so that insects would be carried by the deflected air current over and above the motor vehicle. Air current deflector shields are also often attached to the back edge of the roof of a station wagon. In this position, the air current deflector shield helps to keep the rear window of the station wagon clean. A third position where air current deflector shields are often attached is to the leading edge of the roof of a motor vehicle. In that position, the air streams flowing over the roof of the motor vehicle are deflected away from the leading blunt surface of a trailing vehicle. Such a shield would of course be structurally more substantial than the shield attached to the front edge of the hood or trailing edge of the roof of a station wagon.

To date, there has been no known structures which combine an antenna with an air current deflector shield having a solid surface.

SUMMARY OF THE INVENTION

The present invention provides an improved antenna structure for a motor craft and a method of constructing such antenna as an add-on accessory or as an integral portion of the motor craft itself. The antenna structure has a generally planar member in which a conductor member is encapsulated within an electrically insulated material. In one embodiment of the invention, the planar member is an integral part of a cab cover which encloses the area around the driver and instrument panel of a tractor. In alternative embodiments, the planar member may comprise an accessory for mounting onto the outside surface and transverse to the body of the motor craft. For the purposes of this application, "motor craft" is defined to include land motor vehicles and marine crafts, such as boats.

The planar member is formed from an electrically insulating material that can be applied and shaped in an encapsulating manner around the conductor member. In a preferred embodiment, the material used is fiberglass.

At least one conductor member for providing antenna reception and/or transmission is encapsulated within the planar member. The conductor member may be of any suitable shape and preferably has an elongate primary member and a plurality of secondary members connected and arranged generally perpendicularly to the primary member. In the preferred embodiment, the primary member and the secondary members lie substantially in the same plane. If more than one antenna conductor member is housed within the planar member, the conductor members are electrically separated by an insulating material.

The invention includes a method of constructing the planar antenna. According to a preferred embodiment method of constructing a dual antenna, a first layer of a hard gel coat is formed in the desired planar shape and outline, as for example, in the shape of a bug deflector shield. A second layer formed from successive layers of resin, fiberglass, and resin is placed in overlaying engagement upon the gel coat. A first conductor member is positioned on and is slightly embedded within the second layer. A third layer formed from successive applications of a resin, fiberglass and resin is placed in overlying engagement upon the first conductor member. A second conductor member is placed on top of and is slightly embedded within the third layer. A fourth layer formed from successive applications of resin, fiberglass and resin is placed in overlying engagement upon the second conductor member, and the entire assembly is allowed to cure. If a single antenna is constructed, the fiberglass forming process is completed after formation of the third layer. Similarly, if more than two antenna conductors are to be incorporated within the structure, successive layers of conductor and resin, fiberglass resin are deposited in overlying relationship with one another until the desired number of conductors have been incorporated within the structure. It is possible to have 8 or more antenna conductors incorporated within the structure.

Means for electrically connecting the conductor members to a receiver/transmitter within the motor vehicle are provided. One end of each conductor member is connected to a coupler. The coupler has a first terminal to provide electrical connection with a ground or reference and a second terminal to provide electrical connection to the input/output terminal of the receiver/transmitter within the motor vehicle.

When the planar member is constructed as an integral portion of the cab enclosure, the need for an external mast antenna is eliminated. Also, two or more antennas can be easily incorporated within the cab enclosure.

When the planar member is used as an accessory for mounting on the outside surface of a motor vehicle means for fastening the planar member to the outside surface are provided. The planar member of the preferred embodiment provides the useful combination of one or more antennas with an air current deflector shield. The planar member is easy to install and reduces the likelihood of vandalism, as compared to a mast antenna. The invention will be described in more detail with reference to the attached Drawing.

BRIEF DESCRIPTION OF THE DRAWING

FIG. 1 is a view in perspective of the antenna of the present invention illustrated as applicable as a wind deflector, fastened to the front of a truck.

FIG. 2 is a view in perspective of the antenna of the present invention, illustrated as applicable as a wind deflector fastened to the rear of a station wagon.

FIG. 3 is a view in perspective of the antenna of the present invention, illustrated as applicable as a wind deflector fastened to a tractor-trailer cab.

FIG. 4 is a view in perspective of the antenna of the present invention illustrated as incorporated as an integral portion of a tractor cab.

FIG. 5 is an enlarged view in front elevation of the antenna illustrated in FIG. 1, with portions thereof broken away.

FIG. 6 is a side elevation of the antenna shown in FIG. 5.

FIG. 7 is an exploded perspective view of the antenna of the present invention, illustrating the plurality of layers comprising a composite dual antenna.

FIG. 8 is a front elevational view of the conductor members of the antenna, shown in FIG. 5, illustrating the relative interdigital positioning of the finger portions of the conductors.

FIG. 9 is a cross-sectional view of the antenna shown in FIG. 5, taken generally along the line 6—6.

DESCRIPTION OF THE PREFERRED EMBODIMENT

Referring to the drawing, wherein like numerals represent like parts throughout the several views, an antenna designated generally at 10 is shown in FIGS. 1 through 4. In the embodiments shown in FIGS. 1 through 3, the antenna is configured for mounting as an accessory on an outside surface of the motor vehicle. In other embodiments, not shown, the antenna is mounted as an accessory to the outside surface of a marine craft. Preferably, such mounting will orient the antenna transverse to the direction of travel of the vehicle. The antenna shown in FIG. 4 comprises an integral part of a cab cover, of the type typically used to enclose the area around the driver and instrument panels of a tractor. It will be appreciated that the antenna could equally well be incorporated within other motor craft structures such as within the hull or superstructure of a boat or ship.

The antenna basically comprises one or a plurality of conductive members suitable for receiving and/or transmitting electromagnetic wave energy, covered, protected and separated by electrically insulative materials, to provide a composite planar or sheet-like antenna structure 23. An exploded perspective view of one configuration of the antenna 10 of this invention is shown in FIG. 7. The antenna illustrated is of a dual antenna construction. In constructing such a dual antenna, a gel coating may be used to form a first outer layer **23*a* and is formed by applying a coating of the gel material in a mold having the desired planar shape and outline. The outer layer or first layer 23*a* forms a hard, smooth protective outer layer suitable for providing an aerodynamically stable air deflector surface or an aesthetically pleasing appearance for a vehicle cab structure. The second layer 23*b* is formed from an electrically insulating material. In the preferred embodiment illustrated, the second layer 23*b* is formed by placing successive layers of polyester resin, fiberglass and polyester resin in overlying engagement upon the first layer 23*b*. A first conductor member 11 is positioned on and slightly embedded within the second layer 23*b*. A third layer 23*c* is formed by placing successive layers of polyester resin, fiberglass and polyester resin in overlying engagement with the first conductor member 11. The first conductor member 11 is thereby encapsulated between the second layer 23*b* and the third layer 23*c*. For the dual antenna configuration, a second conductor member 31 is positioned on and is slightly embedded within the third layer 23*c***. The first conductor member 11 is thereby separated from the second conductor member 31 by an electrically insulating material, namely the third layer 23c. A fourth layer 23d is formed by placing successive layers of polyester resin, fiberglass and polyester resin in overlying engagement upon the second conductor member 31. The second conductor member 31 is thereby encapsulated between the third layer 23c and the fourth layer 23d. After fabrication of the various layers, the entire assembly is allowed to cure while the preferred embodiment has a polyester resin, it is understood that any suitable resin, preferably a plastic resin may be used. It is also understood that a suitable fiber reinforced plastic may be used for the resin and fiberglass combination.

The electrically insulating material may be any suitable material that would encapsulate the first conductor member 11 and the second conductor member 31. For example, in a "layered" construction of the antenna structure, as above described, an epoxy resin could be substituted for the polyester resin. It would also be possible to use the polyester resin with any suitable laminating fabric material in place of the fiberglass. The electrically insulating material could also be a plastic. The second layer 23b, third layer 23c, and the fourth layer 23d could be extruded layers of plastic. With such construction, there would be no need for the first layer 23a of a hard gel material. The extruded second layer 23b of plastic would also serve as the first layer 23a. It should be noted that the first layer 23a provides an aesthetically pleasing outer surface. Numerous finishing materials could be used in place of the hard gel coat, or if aesthetics were not important, the first layer 23a could be eliminated.

If a dual antenna with two conductor members is not required, but only a single antenna is required, the second conductor member 31 and the fourth layer 23d may be omitted. Similarly, if more than two antenna conductors are to be incorporated within the structure, successive layers of conductor and polyester resin, fiberglass and polyester resin are deposited in overlying relationship with one another until the desired number of conductors have been incorporated within the structure.

It will also be appreciated that another alternative would be to eliminate the "layered" method of construction, and to simply mould the antenna structure by means of a continuous pouring process.

In the preferred embodiment, the first and second conductor members 11 and 31 are generally of the same configuration. Each has an elongate primary member 12 and a plurality of secondary members 13 connected to and extending generally perpendicularly to the primary member 12 (see FIG. 8). The primary member 12 and secondary members 13 lie in substantially the same plane. The first and second conductor members 11 and 31, as separated by the insulating layer 23c, lie in substantially parallel planes. The secondary members 31 may be connected generally by their midsections to the primary member 12, as shown in FIG. 8, or may be connected at one end of the secondary members 13, forming the general configuration of a comb (not illustrated). It is recognized that for different frequencies, different grid designs for receiving and transmitting may be desirable. The size of the first and second conductor members 11 and 31 is between 25 to 20 gauge. However, it is understood other suitable sizes may also be used.

Means for electrically connecting the first conductor member 11 and second conductor member 31 to a receiver/transmitter within the motor vehicle are provided. In one embodiment, the connecting means comprises a first coupler 18 and a second coupler 32, which are rigidly mounted to the planar member 23 after it has cured. One end 36 of the first conductor member 11 passes through the third layer 16 and fourth layer 17 and is connected in circuit to the first coupler 18. One end 37 of the second conductor member 31 passes through the fourth layer 17 and is connected to the second coupler 32. The first coupler 18 has a first terminal 19 for providing connection with a ground or reference and a second terminal 20 is operatively connected to the one end 36 of the first conductor member 11 to provide an electrical signal flow path to the input/output terminal of the first receiver/transmitter within the motor vehicle. The second coupler 32 also has a first terminal 19 for providing connection with a ground or reference and a second terminal 20 is operatively connected to the one end 37 of the second conductor member 31 to provide an electrical signal flow path to the input/output terminal of the second receiver/transmitter within the motor vehicle. Typically, the couplers 18 and 32 would be of a type suitable for connection to a coaxial shielded electrical cable.

FIG. 8 shows the relative interdigital positioning of the finger portions of the conductors. Only the first conductor member 11 and second conductor member 31 are shown, with no layers of planar member 23 being shown.

When viewed as in FIGS. 5 and 8, the first conductor member 11 is offset with respect to the second conductor member 31. Second conductor member 31 is shown as a dashed line only to aid in distinguishing it from first conductor member 11. This offset positioning provides a relatively flat surface when the conductor members 11 and 31 are encapsulated within the planar member 23. If the elongate primary member 12 of the first conductor member 11 were directly over the elongate primary member 12 of the second conductor member 31, the thicknesses of the elongate primary members 12 would tend to make the planar member 23 thicker. The same would hold true if the secondary members 13 were positioned in direct alignment on top of each other.

FIG. 9 shows the primary member 12 of the first antenna conductor 11 embedded in the second layer 23b and third layer 23c, thereby being encapsulated between the second layer 23b and third layer 23c. The primary member 12 of the second antenna conductor 31 is embedded in the third layer 23c and fourth layer 23d, thereby being encapsulated between the third layer 23c and fourth layer 23d.

Similarly, the secondary members 13 of the first antenna conductor member 11 are embedded and encapsulated between the second layer 23b and third layer 23c. The secondary members 13 of the second antenna conductor member 31 are embedded and encapsulated between the third layer 23c and fourth layer 23d.

In one embodiment of the invention, as shown in FIG. 6, the planar member 23 is secured within a mounting strip 21. Brackets 22 provide means for fastening the planar member 23 to the outside surface of a motor vehicle. In one embodiment, the brackets 22 are fastened to the mounting strip 21. The free ends of the brackets 22 are then fastened to the outside surface of the motor vehicle.

As shown in FIG. 1, the dual antenna encapsulated within the planar member 23 is fastened to the front edge of a hood 24 of a motor vehicle, to provide an air current deflection shield. The air current deflection shield deflects the air currents over and above the motor vehicle carrying bugs and insects in the air current. This prevents insects from hitting the hood and windshield of the motor vehicle. The configuration of such an air current deflection shield is well known in the art. The method of fastening such an air current deflection shield to the front edge of a hood 24 is also well-known in the art and will not be detailed herein.

As shown in FIG. 2, the dual antenna encapsulated within the planar member 23 is fastened to the back edge of a roof 25 of a motor vehicle. When fastened in such a location, the shield helps keep the back window of the motor vehicle clean. Again, the method of fastening such an air current deflector shield to the back edge of a roof 25 is well known in the art and will not be belaboured herein. It is also well known in the art how to size and shape such a shield.

As shown in FIG. 3, the dual antenna encapsulated within the planar member 23 may be fastened to the leading edge of a roof 26 of a motor vehicle. In such position the air streams flowing over the roof of a motor vehicle are deflected by the shield away from the leading blunt surface 33 of a trailing vehicle 34. An air current deflection shield of this type is preferably of more substantial construction than that of the shields discussed in the previous two paragraphs. However, the techniques for constructing and fastening such shields to a motor vehicle are well-known in the art.

As seen in FIG. 4, the dual antenna encapsulated within the planar member 23 can also be formed as an integral portion of a cab cover 27. Such a cab cover 27 could enclose, for example, an area around a driver and instrument panel of a tractor. The cab cover 27 has a box-like fiberglass shell 35 having four walls and a roof. A planar member 23 of fiberglass is integrally formed within any one of the walls or within the roof. The planar member 23, along with the encapsulated first conductor member 11 and second conductor 31 and the means for electrically connecting the first conductor members 11 and second conductor member 31 to a first and second receiver/transmitter within the tractor, is the same as the construction of the planar member 23 that is mounted as an accessory on the outside surface and transverse to the body of a motor vehicle.

Other modifications of the invention will be apparent to those skilled in the art and in light of the foregoing description. This description is intended to provide specific examples of individual embodiments which clearly disclose the present invention. Accordingly, the invention is not limited to these embodiments or the use of elements having these specific configurations and shapes as presented herein. All alternative modifications and variations of the present invention which fall within the spirit and broad scope of the appended claims are included.

What is claimed is:

1. A combination dual antenna and air current deflector shield for mounting as an accessory on an outside surface and transverse to a body of a motor vehicle comprising:

(a) a planar member having a first layer of a hard gel coat and second, third and fourth layers of polyester resin and fiberglass, said planar member being configured in the shape of an air current deflector shield;

(b) a generally planar first conductor member having an elongate primary member and a plurality of secondary members connected to and generally perpendicular to said primary member, said first conductor member being encapsulated between said second and said third layers;

(c) a generally planar second conductor member having an elongate primary member and a plurality of secondary members connected to and generally perpendicular to said primary member, said second conductor member being encapsulated between said third and said fourth layers;

(d) a first coupler mounted to said planar member having a first terminal suitable for providing electrical connection to an electrical reference potential of a motor vehicle and a second terminal operatively connected to the first antenna conductor member suitable for connection to an input/output terminal of a receiver/transmitter; and (e) a second coupler mounted to said planar member having a first terminal suitable for providing electrical connection to an electrical reference potential of a motor vehicle and a second terminal operatively connected to the first antenna conductor member suitable for connection to an input/output terminal of a receiver/transmitter, whereby when said planar member is mounted to the outside surface of a motor vehicle, said planar member is an air current deflector shield.

2. A combination dual antenna and air current deflector shield for mounting as accessory on an outside surface and transverse to a body of a motor vehicle comprising:

(a) a generally planar member having a first layer, second layer and third layer, said planar member being configured in the shape of an air current deflector shield;

(b) a generally planar first antenna conductor member, said first antenna conductor member being encapsulated between said first and said second layers;

(c) a generally planar second antenna conductor member, said second antenna conductor member being encapsulated between said second and said third layers;

(d) electrically insulating means for encapsulating and isolating said first and second antenna conductor members, said encapsulating means forming said planar member;

(e) means for electrically connecting said first antenna conductor members to a first receiver/transmitter within the motor vehicle and said second antenna conductor member to a second receiver/-transmitter within the motor vehicle; and (f) means for fastening said planar member transverse to an outside surface of the motor vehicle, whereby said planar member is an air current deflector shield.

3. The antenna of claim 2, wherein the connecting means comprises:

(a) a first coupler mounted to said planar member having a first terminal suitable for providing electrical connection to an electrical reference potential of a motor craft and a second terminal operatively connected to the first antenna conductor member suitable for connection to an input/output terminal of a receiver/transmitter; and (b) a second coupler mounted to said planar member having a first terminal suitable for providing electrical connection to an electrical reference potential of a motor craft and a second terminal operatively connected to the first antenna conductor member suitable for connection to an input/output terminal of a receiver/transmitter.

4. The antenna of claim 2, wherein;

(a) said first antenna conductor member comprises an elongate primary member and a plurality of secondary members connected to and disposed generally perpendicular to said primary member, said primary member and said secondary members lying in substantially the same plane;

(b) said second antenna conductor member comprises an elongate primary member and a plurality of secondary members connected to and disposed generally perpendicular to said primary member, said primary member and said secondary member lying in substantially the same plane; and (c) said first antenna conductor and said second antenna conductor lie in substantially parallel planes.

5. The antenna of claim 2, wherein said planar member comprises:

(a) a first layer of a hard gel coat material;

(b) second, third and fourth layers of a polyester resin and fiberglass;

(c) said first antenna conductor member being encapsulated between said second and said third layers; and (d) said second antenna conductor member being encapsulated between said third and said fourth layers.

6. The antenna of claim 2, wherein said planar member comprises first, second and third layers of extruded plastic, said first antenna conductor being encapsulated between said first layer and said second layer and said second antenna conductor being encapsulated between said second and said third layers.

7. The antenna of claim 2, wherein said planar member is configured in the shape of an air current deflection shield suitable for mounting adjacent the front edge of a motor craft hood.

8. The antenna of claim 2, wherein said planar member is configured in the shape of an air current deflection shield suitable for mounting adjacent the rear edge of a roof of a motor craft.

9. The antenna of claim 2, wherein said planar member is configured in the shape of an air current deflector shield suitable for mounting to the roof of a motor craft.

10. A method of constructing a planar antenna comprising the steps of:

(a) applying a coating of material in a mold configuration in a generally planar shape to form a hard protective first layer;

(b) placing an electrically insulating second layer in overlying engagement with said first layer;

(c) placing a first conductor member on and slightly embedded within said second layer;

(d) forming an electrically insulating third layer in overlying engagement with said first conductor member, whereby said first conductor member is encapsulated between said first layer and said second layer;

(e) placing a second conductor member on and slightly embedded within said third layer;

(f) forming an electrically insulating fourth layer in overlying engagement with said second conductor member, whereby said second conductor member is encapsulated between said third layer and said fourth layer;

(g) making electrical contact to one end of the said first conductor member through said third layer;

(h) making electrical contact with one end of said second conductor member through said fourth layer;

(i) allowing the entire assembly to cure; and (j) removing the assembly from the mold.

11. The method of claim 10 wherein the forming of said second layer comprises:

(a) placing polyester resin in overlying engagement with the first layer;

(b) placing fiberglass in overlying engagement with said polyester resin; and (c) placing polyester resin in overlying engagement with said fiberglass.

12. The method of claim 10, wherein the forming of said third layer comprises:

(a) placing polyester resin in overlying engagement with said conductor member;

(b) placing fiberglass in overlying engagement with said polyester resin; and (c) placing polyester resin in overlying engagement with said fiberglass.

* * * * *